United States Patent [19]

Martin

[11] Patent Number: 4,756,521

[45] Date of Patent: Jul. 12, 1988

[54] METHODS AND APPARATUS FOR TURNING FLAT ARTICLES

[75] Inventor: Samuel W. Martin, Weston, Conn.

[73] Assignee: Pitney Bowes Inc., Stamford, Conn.

[21] Appl. No.: 25,248

[22] Filed: Mar. 12, 1987

[51] Int. Cl.[4] ..... B65H 5/00

[52] U.S. Cl. ..... 271/225; 271/185; 198/457

[58] Field of Search ..... 198/369, 372, 457; 271/225, 184, 185, 251

[56] References Cited

U.S. PATENT DOCUMENTS

| | | | |
|---|---|---|---|
| 2,243,557 | 5/1941 | Firster | 271/225 |
| 3,782,527 | 1/1974 | Petershack | 198/372 |
| 4,359,219 | 11/1982 | Garavuso | 271/225 |
| 4,437,560 | 3/1984 | Wolf | 198/372 |

FOREIGN PATENT DOCUMENTS

| | | | |
|---|---|---|---|
| 48308 | 8/1983 | Switzerland | 271/184 |
| 588172 | 1/1978 | U.S.S.R. | 198/457 |

*Primary Examiner*—H. Grant Skaggs

*Attorney, Agent, or Firm*—Lawrence E. Sklar; David E. Pitchenik; Melvin J. Scolnick

[57] ABSTRACT

An apparatus is disclosed for turning flat articles. The apparatus includes an apparatus for receiving a serial stream of the articles which are traveling along a first linear path, the path including a nonrotating surface. There is a rotating device which causes each article to rotate through a pre-selected angle. The device also steers the articles in a pre-selected direction by a roller. A guiding apparatus causes each article to be properly directed, and a conveying device causes each rotated article to be conveyed along a path which is parallel to the pre-selected direction of travel. The apparatus is utilized in executing a method for receiving, rotating and conveying the articles along the pre-selected direction.

11 Claims, 4 Drawing Sheets

315
303
316
355a
307
309a
430
309
308
355
304
305
399
312
406
398
402
301a
406b
405
403
388
450
302
304
501
310
311
388
201
250
207
306
303
203
101
150
306
303
103
102

METHODS AND APPARATUS FOR TURNING FLAT ARTICLES

BACKGROUND OF THE INVENTION

1. Field of the Invention

The invention relates generally to methods and apparatus for turning flat articles and is particularly related to methods and apparatus used for turning envelopes.

2. Description of the Related Art

Turning devices for flat articles that are conveyed horizontally are required in mail processing machines. Examples of flat articles are envelopes, letters, postcards, endless forms issued by a computer controlled printing device that are cut into sheets from an endless web and the like. For example, in an inserter and mail processing machine, sheets are fed one by one, or collected together, to a folding station and subsequently, with or without additional enclosures, are conveyed to an inserting station where the sheets are inserted into an envelope.

After insertion of the sheets into the envelope, the stuffed envelope is forwarded to a postage station where postage is imprinted thereon by a postage meter. In certain inserters, it is necessary to turn the stuffed envelopes either through a 90° or 180° angle. The first case is required if the direction of travel by envelopes through the postage meter is the same as the direction of discharge from the inserting station and the second case is required if the postage meter is connected to the inserting station at a 90° angle relative to the direction of discharge.

In a known device of this kind, as described in U.S. Pat. No. 2,746,221, the envelopes are transferred with their length perpendicular to the direction of travel through the inserting station and received by a rotatable turntable device. The device is driven by the main motor of the inserter through a gear in such a manner that movable gripping arms are provided in the clamping device which engage the envelope to clamp it on the rotatable table of the turning device and retain it until the envelope has been turned 180° by rotation of the turntable. Thereafter, the envelope is received by the postage station, which is located at a 90° angle relative to the direction of travel of the inserting station, and fed to the postage station. In this device, however, the gripping arms, which are controlled by a cam disc, cause a predetermined spring force to be applied to the envelope on the rotatable turntable during its angular rotation so that there exist different pressing forces upon envelopes of different thicknesses.

Additionally, a relatively high noise level is occasioned by the cam disc for controlling the gripping arms as well as the Geneva motion required for driving the turntable. Particularly, lowering of the arms creates noise. Further yet, because the components suffer relatively high wear, the wear on the gripping arms may result in envelopes no longer being securely clamped, particularly at high processing speeds.

To solve the aforementioned problems, the assignee of the instant invention has disclosed a turning device with a modified clamping mechanism, for turning flat articles through a preselected angle, in copending application Ser. No. 718,327 filed on Apr. 1, 1985, entitled "DEVICE FOR TURNING FLAT ARTICLES", in the name of Karl-Heinz Abels, which is hereby incorporated by reference.

The apparatus disclosed in the incorporated application includes a clamping device having two coaxially aligned discs which are coupled to rotate in unison and are axially movable towards one another. The articles to be turned are inserted between the two discs and can be discharged at a predetermined angular position. The clamping device is provided with a driving mechanism by which the discs can be moved between axially spaced apart positions. When a predetermined pressing force is attained upon an article being retained by the discs, the discs can be locked in position during the angular rotation of the turntable unit in order to maintain a constant pressure on the articles being turned. Still, the object to be turned must first be gripped by the clamping device, i.e., be locked for a period of time between the retaining discs and then be released at the appropriate time after the article has been turned through the predetermined angle. Other known types of turning devices are typified by Daily in U.S. Pat. No. 3,758,104, issued Sept. 11, 1973, entitled "TURNING APPARATUS", which instead of using a clamp comprised of 2 discs to grab and release an article, uses a conveyor and means forming two nips generally transverse to the conveyor to turn an article. According to Daily, an inward disc is mounted on a shaft above the conveyor and is free-wheeling with respect to the shaft in order to form a first article engaging nip with the conveyor. An outward disc is secured to the shaft and forms a second article engaging nip with a third disc freely mounted beneath the outward disc on a shaft which drives an end roll of the conveyor. The outward disc is driven at a speed greater than that attained by the inward disc by virtue of its engagement with the conveyor or a moving article thereon.

When, for example, an envelope is conveyed toward the discs, a portion is caught in the nip formed by the outward disc and the third disc. This portion of the envelope is accelerated while the portion of the envelope between the conveyor and the freewheeling disc remains at conveyor velocity. The envelope is thus turned about that area between the conveyor and the freewheeling disc and is discharged from the conveyor to further apparatus such as a postage meter device. The apparatus disclosed in the Daily Patent although providing means to turn an article without using the prior art clamping arrangement, does not accommodate turning articles 180°, requires two discs for the 90° turn alone, and requires a conveyor belt between the rotating discs to turn the article. The conveyor belt as a part of the turning device apparatus introduces a separate maintenance and operating element and will be seen to be an unnecessary element to provide 90° and 180° turning capabilities in a turning device. The prior art also encompasses article turning devices, typified by Crawford in U.S. Pat. No. 4,085,839, which do not require rotating discs or clamps. In the Crawford Patent a conveyor belt is again required, but this time is used with side belts for grasping an article to achieve a 90° rotation. Still further, Bashford et al, in U.S. Pat. No. 4,448,407, issued May 15, 1984, and Bashford in U.S. Pat. No. 4,506,878, issued Mar. 26, 1985, teach sheet moving apparatus comprising a combination of a rotatable member, such as a disc, and a movable or pivotal member, including an engaging roller, to change the track in which a document is being conveyed. The Baskford apparatus requires movement of the pivotal member and engagement of one or more rollers with the rotating turntable in order to change the track of an article. In addition to all these moving parts, Bashford does not accommodate applications where the article needs to be turned 180°.

In addition to all of the aforementioned problems related to moving parts, noise and wear, the known prior art equipment is bulky, costly and not safe to operate, particularly in view of the number of high-speed moving parts exposed to the operator. It has been determined that it would be advantageous to have an article turning device not requiring a conveyor mechanism to perform the turning per se. In this way the device could be made modular; i.e., could be married to a variety of devices which deliver and/or receive the articles by any known means, e.g., conveyor; injection, etc. Still further, it has been determined that it would be advantageous to have a turning device, with few moving parts, that is a device that is easy to maintain, quiet, and capable of selectively rotating articles through 90° or 180°. This would be particularly useful in the aforementioned inserter and mailing machine combinations where the position of the mailing machine determines how far the envelopes need to be turned. Further yet, it would be advantageous to have a turning device which is inherently safe to operate. To address these objectives the assignee of the instant invention has disclosed flat article turning methods and apparatus in copending application Ser. No. 2,487 filed on Jan. 12, 1987, entitled "Methods and Apparatus For Turning Flat Articles" in the name of Samuel W. Martin now U.S. Pat. No. 4,724,945, which is hereby incorporated by reference. These methods and apparatus are operative in a first mode to take as input a stream of articles delivered along a first path, turn each article 180° and then urge the articles to continue along a second path at a right angle to the first path. These methods and apparatus are also operative in a second mode to take the input stream of articles, turn each article 90° and then urge the articles to continue along the first path. The apparatus disclosed in said Martin copending application includes a substantially flat surface for receiving said articles and means for guiding the articles to the nip of a first, fixed position, pair of rollers. The rollers grab a given article and urge it to pivot 90° about a fixed stop. A second fixed position pair of rollers is used when a 180° pivot is desired. In either case no turntables are used to rotate an article. The surface on which articles are received does not rotate, only the roller pairs rotate. It has proven desirable in some applications to substantially retain the benefits realized by the methods and apparatus disclosed in the Martin copending application and at the same time minimize both the number of rollers which come in contact with the envelopes being turned. Again, the context for operating the desired alternative is on a substantially flat stationary surface as opposed to the prior art devices, such as the devices taught in the referenced Bashford patents, that operate with rollers coming in contact with turntable type rotating surfaces.

SUMMARY OF THE INVENTION

According to the instant invention, flat article turning methods and apparatus are disclosed which are operative in a first mode to take as input a stream of articles delivered along a first path, turn each article 90° and then urge the articles to continue along a first path. The disclosed methods and apparatus are also operative in a second mode to take the input stream of articles, turn each article 180° and then urge the articles to continue along a second path at a right angle to the first path. The apparatus includes a substantially flat surface for receiving said articles and means for guiding the articles to the nip of a pivotable roller assembly. The roller, operating on a nonrotating surface, grabs a given article and urges the article to pivot about a fixed stop. In the second mode referred to hereinbefore, the roller will drive the article along a 180° arc around the stop by the roller assembly pivoting 90° about the stop while the roller itself tracks 90° of arc on the envelope. The result is that the roller assembly pivots 90° and the envelope 180° in this first mode. The pivoted roller then drives the envelope down the 180° path, according to the preferred embodiment of the invention, until takeaway rollers eject the envelope into a mailing machine. Once the envelope is driven beyond the roller, the roller falls into a track where the roller to surface friction is high and thus the roller (and roller assembly) is returned to its initial position. In the first mode, where the article path after turning the envelope 90° is to be the same as the first path, a stop device is introduced into the path of the turning article so that as to prevent the article from being rotated in excess of 90°. The roller rotates; but pivoting action is inhibited in the first mode since the roleer operates as a fixed position roller to achieve the desired 90° rotation of the article. After the 90° rotation of the article and its contact with the stop device, the roller, remaining fixed in its initial position, will cause the article to continue straight, along the first path, against a guide which may be placed in line with the first path. Again, takeaway rollers may be used to eject the article into a mailing machine or the like. It is an object of the invention to provide article turning methods and apparatus which do not require clutches, brakes or conveyor belts and which require only a single roller operating on a nonrotating surface to effect the turning of articles. It is a further object of the invention to provide a device which is modular. It is still a further object of the invention to provide article turning methods and apparatus which are capable of selectively rotating articles through 90° or 180° for use in combination with inserter and mailing machines.

Further yet, it is an object of the invention to provide a turning device which is inherently safe in that a minimum number of high-speed moving parts are exposed to an operator. These and other objects and features of the present invention will become apparent to those skilled in the art upon consideration of the following detailed description and the accompanying drawings, in which like reference designations represent like features throughout the figures.

Further yet, it is an object of the invention to provide a turning device which is inherently safe in that a minimum number of high-speed moving parts are exposed to an operator. These and other objects and features of the present invention will become apparent to those skilled in the art upon consideration of the following detailed description and the accompanying drawings, in which like reference designations represent like features throughout the figures.

BRIEF DESCRIPTION OF THE DRAWING

FIG. 6 is a top, plan view depicting several positions of an envelope, varying with time, as it is being turned 180° by the apparatus depicted in FIG. 3, i.e., with the apparatus operating in said first mode.

DESCRIPTION OF THE PREFERRED EMBODIMENT

Figures 1, 2, 4, 5:
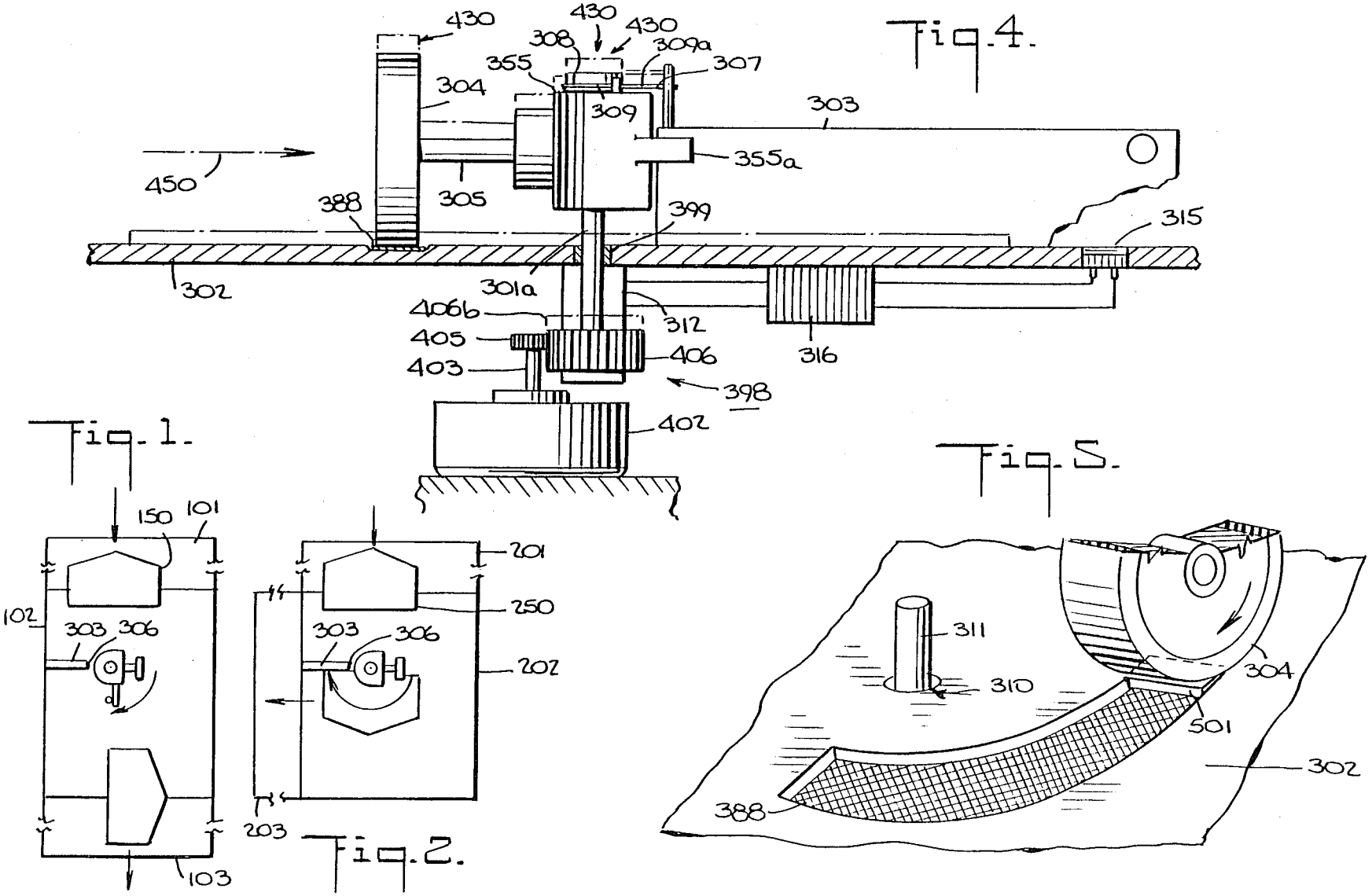
FIG. 1 is a schematic, plan view of an envelope turner in accordance with the instant invention as it rotates an envelope 90°.
FIG. 2 is a schematic, plan view of the envelope turner seen in FIG. 1 as it rotates an envelope 180°.
FIG. 4 is a sectional view taken on the plane indicated by the line 4—4 in FIG. 3, showing the components used, in accordance with the preferred embodiment of the invention, to provide rotating motion for the roller and means to inhibit the pivoting action of the roller assembly.
FIG. 5 is an enlarged view showing the track on the stationary surface upon which, according to the preferred embodiment of the invention, the roller rotates and pivots in a first mode, and rotates as a fixed position roller in a second mode.

In FIG. 1, an inserting machine 101, turning device 102 and a mailing machine 103 are shown "in line", i.e., with the direction of travel of articles through the mailing machine 103 in the same direction as through the inserter 101. According to the preferred eontext in which the invention may be utilized, the objective is to turn an article, such as an envelope 150, 90° prior to the continued in-line movement of the article through the mailing machine 103. This facilitates applying postage to a corner of the article by a postage meter (not shown) which is typically part of the mailing machine 103.

Figure 3:
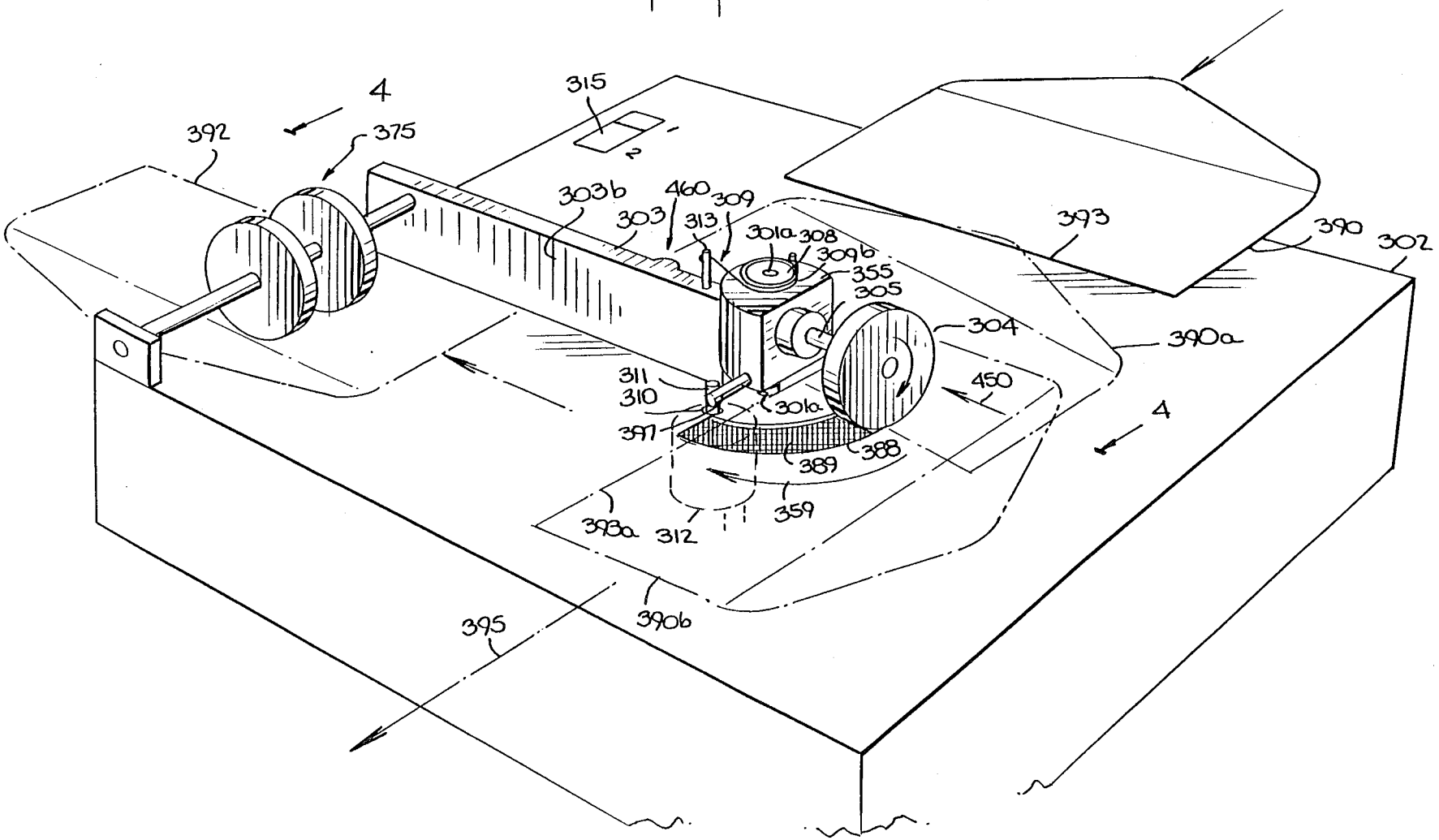
FIG. 3 is an isometric view of the turning device constructed in accordance with the preferred embodiment of the invention.
Figure 5:
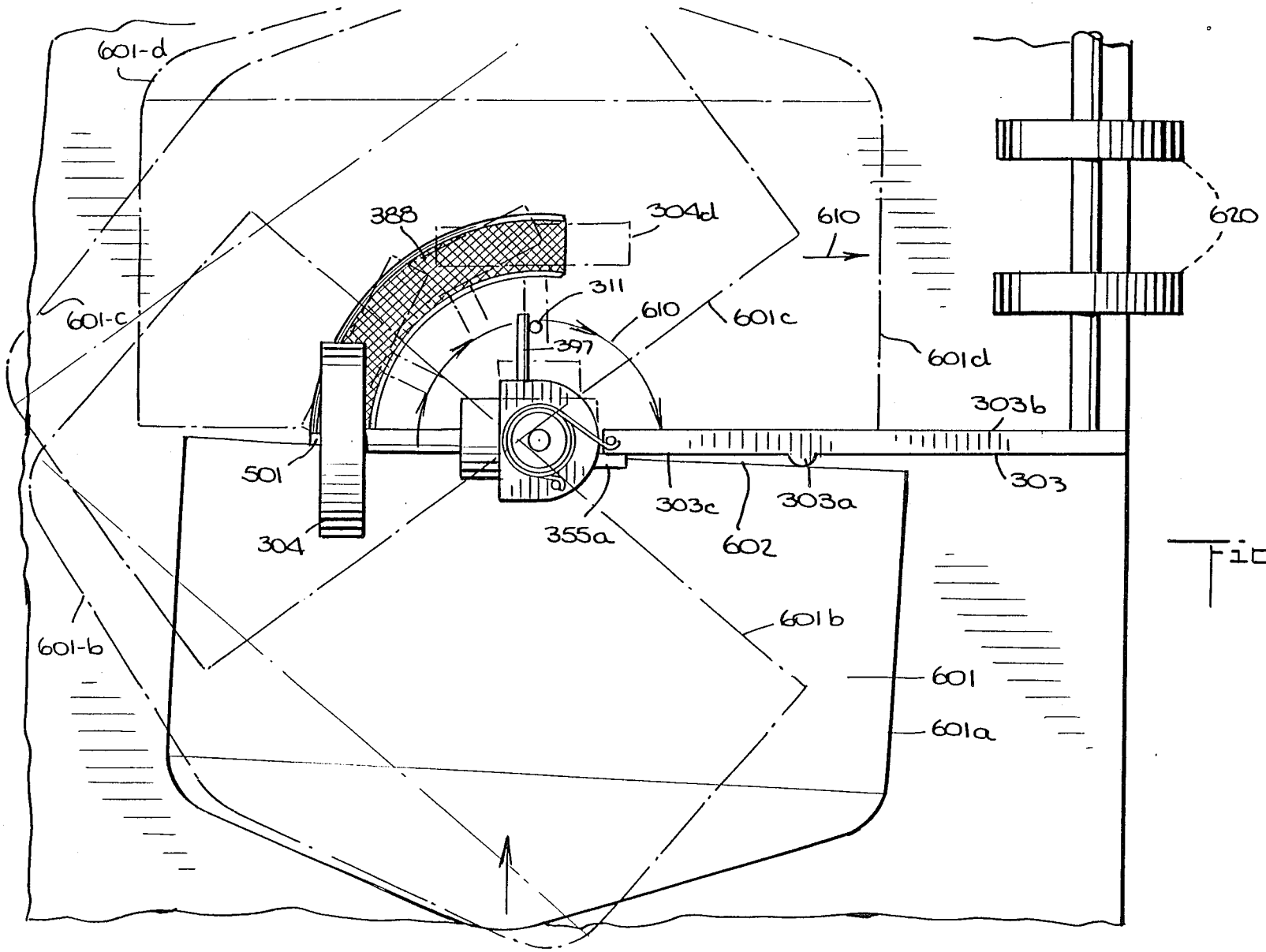

FIG. 2 depicts a combination of inserter 201, turning device 202 and mailing machine 203 where inserter 201 and mailing machine 203 are not in line. Here the mailing machine 203 is stationed at a right angle to the invserter 201, and an article, such as an envelope 250, needs to have its direction of travel changed, i.e., be "steered" by 90°, in addition to having to be rotated by 180° for postage to be properly affixed. To perfrom the desired rotation and steering of articles, the turning device of the preferred embodiment of the invention is operative in either of two modes which accommodate the equipment configurations depicted by FIG. 1, (Mode 1) and FIG. 2 (Mode 2). It will be noted that the Modes 1 and 2 may be otherwise referred to in the present specification as a first Mode and a second Mode respectively. FIG. 3 depicts a turning device constructed in accordance with the preferred embodiment of the invention, in which a roller assembly is shown mounted over a flat deck surface 302. The roller assembly is comprised of a spindle 301*a*, a roller 304, an axle 305 and a housing 355, each described in detail hereinafter. Spindle 301*a* is shown standing vertically upright, in line with a fixed fence 303. The roller assembly can move up and down on spindle 301*a* to accommodate different article thicknesses. The axis of roller 304 and axle 305 are both aligned with the fixed fence 303. There is a torsion spring 309 which is mounted on a hub 308 of the housing 355. An arm 309*a* of the spring 309 engages an upright pin 313 which is located adjacent to the pivot point 306 of the fence 303 (the pin 313 is pressed into the fence 303). A second arm 309*b* of the spring 309 engages the housing 355, which causes a moment (bias) of the roller assembly in direction 359.

A hole in deck 302 is provided in the preferred embodiment of the invention to permit a pin 311 which is attached to a solenoid 312. The pin 311 is selectively raised and lowered above the level of the deck 302 when the solenoid 312 is energized. The pin 312 is normally held below the deck 302 by the solenoid 312 (energized selectively by an appropriate mode switch 315 selected by the operator on the deck 302). The solenoid 312 is operatively connected to an electrical unit 316 which will be understood by those skilled in the art to enable energization of the electromagnetic solenoid 312. Alternatively, an appropriate signal from the inserter 101 or 201 may be used to reject an envelope into an appropriate receiving bin.

FIG. 3 also depicts a track 388 in the deck 302, preferably knurled and recessed, over which the roller 304 (on top of an article) will track a path when the roller assembly is pivoted by influence of the spring bias of the torsion spring 309.

Referring to FIG. 4, a portion of the apparatus including a drive apparatus 398 located immediately beneath the deck 302 will now be described. The housing 355 of the roller assembly is rotatably coupled to the deck 302 by the spindle 301*a* which is supported in a bearing 399, mounted in the deck 302. Further seen in FIG. 4, there is a motor 402, an axle 403, spindle 301*a*, and a pair of gears 405 and 406, the motor 402, the housing 355, spindle 301*a*, gears 405 and axles 403 and 305, combined as depicted, are used to rotate the roller 304 in a clockwise direction when the axis of the roller 304 is viewed along a line 450 seen in FIG. 3.

An envelope or other article, directed to the nip of the roller 304 in its initial position over the track 388, is caught by the nip of the roller 304 which subsequent rotates and steers the envelope as indicated herein.

Acceptance of varying degrees of envelope thickness is accounted for by the apparatus indicated in broken lines in FIG. 4. The gear 406 may be seen to move up to a position 406*b* from a position 406*a* with respect to gear 405 (the motor 402 and gear 406 remains in a fixed vertical position) an an envelope is caught by roller 304. Since the gear 406 is fixed to the spindle 301*a*, the roller assembly and all connected elements including the axle 305, roller 304 and housing 355, are shown to move up to a depicted broken line position 430 to accommodate variations in the article envelope thickness. Whenever an envelope is grabbed by the roller 304, the spring bias extremely the spring 309 will attempt to rotate the entire roller assembly. When an envelope leaves the nip of the roller 304 the roller assembly, all connected components including the gear 406 return to the lower position where the gear is at the position 406*a*, and the roller 304 is resupported on the track 388, thereby supporting the entire roller assembly. From the preceding description, it will be recognized that the roller assembly is therefore ready to accept varying thicknesses of envelopes. According to the preferred embodiment of the invention, the initial position portion of the track 388 contains a low friction surface, such as a plastic pad 501 depicted in FIG. 5. The pad 501 minimizes wear on the roller 304 as it rotates in the waiting position shown in FIG. 3. The roller 304 continuously rotates being driven by the motor 402 and other associated connecting drive components previously described.

Continuing to describe the components of the apparatus shown in FIG. 3, (as previously described) the solenoid 312 is de-energized and the pin 311 is above the deck 302. The pin will engage the lower end of an envelope to cause the envelope to be guided along a path 305. The roller assembly is maintained in the position shown in FIG. 1 since a pin 397 engages the pin 311 to prevent rotation of the entire roller assembly in the biased direction 359. An envelope 390 moves towards the assembly 301, and is momentarily stopped at a position 390*a*, from which the roller 304 grabs the envelope 390 and causes an immediate rotation of substantially 90° to a position 390*b*. The envelope 390 has an edge 393 which pivots about the spindle 301*a*. The envelope edge 393 then is registered against the pin 311, the new position of the envelope edge 393 being seen as a phantom lne 393*a* in the position 390*b*. The envelope thus moves along the path 395, since the roller 394 urges it in that direction while the pad 501 permits the bottom of the envelope to slip over the pad 501. Referring back to FIG. 3, the solenoid 312 may be seen to be the operative connection for the pin 311 (see FIGS. 3 and 5). Solenoid 312 operates to keep pin 311 below deck 302 whenever the turning device is operating in the Mode 2 condition, which is as was pointed out previously, selected by the operator via the switch 313 located on the deck 302. In addition, it is possible that an appropriate automatic signal from the upstream located inserter 101, having read a control indicia such as that described in U.S. Pat. No. 3,935,429 issued to G. Branecky is described and could be applied to the present invention.

The Mode 2 operation occurs when the aforementioned switch 313 is selected to the Mode 2 position, thereby causing the solenoid 312 to pull the pin 311 down below the deck 302 within the hole 310. Referring to FIG. 6, an envelope 601 is shown in position 601*a* where the roller 304 is able to grab a lower edge 602 of the envelope 601.

The envelope 601 is advanced towards the turning device 202 from an exit end of the inserter 201 (FIG. 2). There is a biasing abutment 303*a*, which is best seen in FIG. 6 where the aformentioned envelope 601 is shown in the positions just described, having been momentarily registered between the abutment 303*a* and the nip defined by the roller 304 and the pad 501, (FIG. 5). At this point, the envelope 601 begins pivoting about the spindle 301*a*, just as it did in Mode 1. The abutment 303*a* insures that the envelope 601 is grabbed, regardless of the Mode selected. While the envelope is turning to a position 601*b*, the roller 304 is allowed to being swinging in a clockwise direction 610 which is the same as the direction 359 previously described. Since there is no restraint offered as there is in Mode 1 where the pin 311 is holding the roller assembly through engagement with the pin 397, the envelope 601 therefore continues rotating about the spindle 301*a* as seen by a phantom position 601*c*, and a rotated 180° position 601*d* where the edge 602 of the envelope is aligned with a surface 303*b* of the fence 303. The roller 304, (and entire assembly 301) has swung to a position 304*d*, all the while continuing to drive the envelope 601 through a 180° angle and finally along a path 610. There is a pair of conveying rollers 620 located downstream along the path 610, which grab the envelope 601 to cause it to be moved towards the mailing machine 203.

Figure 7:
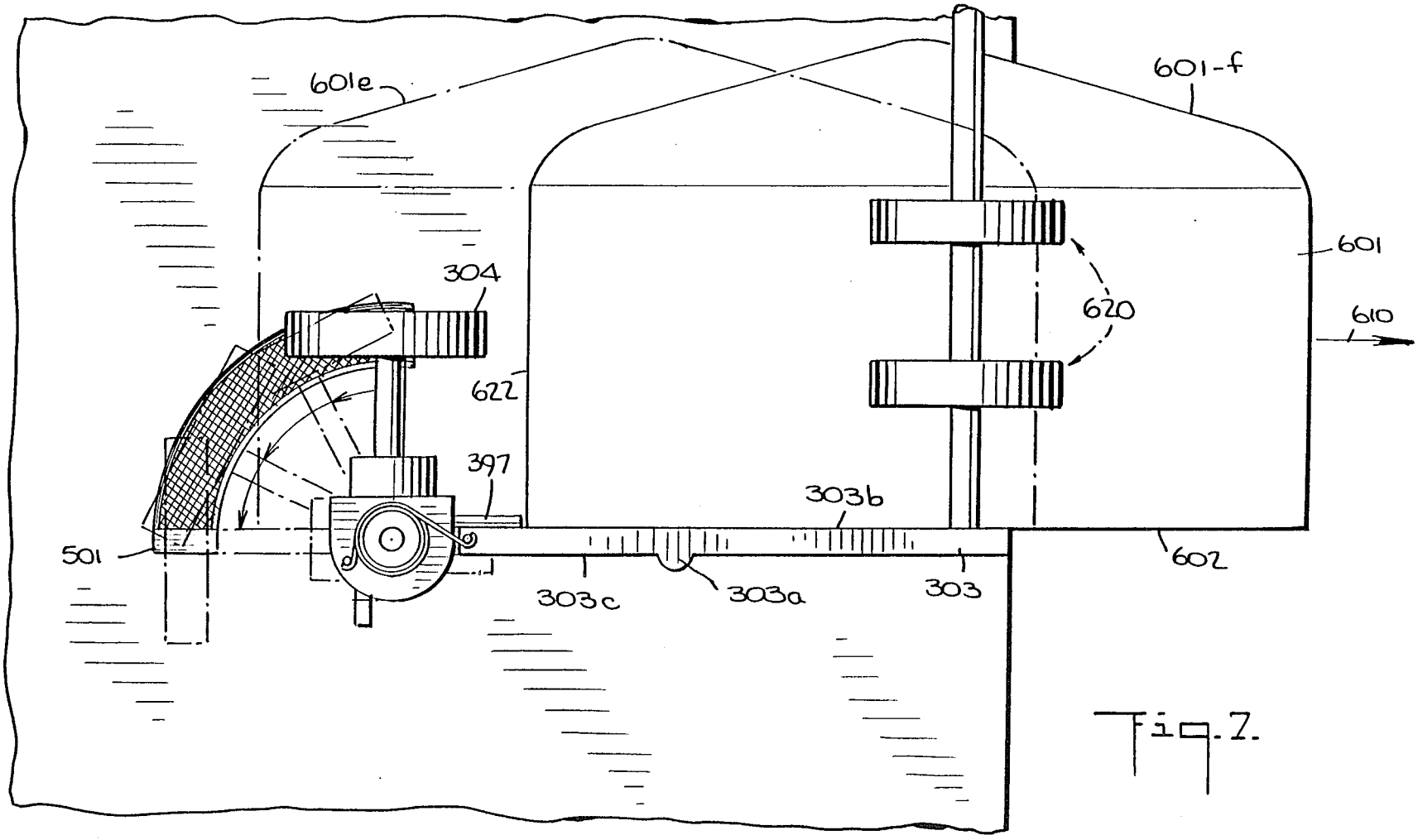
FIG. 7 is a top, plan view depicting the roller assembly being driven to its initial position, when operating in said first mode, as the envelope is ejected by takeaway rollers after having been turned 180°.

Referring to FIG. 7, the envelope 601 is sent to be advanced further along the path 610 and is seen in several positions 601*e* and 601*f*. The pin 397 is resting against the surface 303*b*, thereby maintaining the roller assembly in the rotated position shown in FIG. 7 until a trailing end 622 of the envelope 601 clears the nip of the roller 304. Immediately following the foregoing event, the roller assembly 301 drives itself back to the original position as determined by an abutment member 355*a* (FIG. 6) which causes the assembly 301 to stop rotating when the member 355*a* registers against a wall 303*c* of the fence 303. (The roller 304 drivingly engages the hurled surface 388).

At this point it will be re-emphasized that the solenoid 312 is only operative in the Mode 2 condition where the pin 311 is maintained below the deck 302. Alternatively, a suitable (unseen) bias spring cuases the pin 311 to project above the deck 302, thereby providing the Mode 1 operation selected by the operator. Considering all of the above, one of ordinary skill in the art will readily appreciate that once the envelope is grabbed, the aforementioned roller assembly 301 can be engaged by other electrical or mechanical contacts or latches. This "grabbing" and raising of the roller 304 is what initiates the pivoting action of the roller assembly 301 in mode 1 which in turn causes the roller 304 and envelope 601 depicted in FIG. 6 to pivot.

The envelope's position is indicated as position 601*b*, 601*c* and 601*d* respectively. After a very short period of time the envelope 601 has rotated 180° and the roller assembly has rotated 90° from its initial position. It should be noted again here that if the pin 311 is above deck 302, and roller 394 is fixed in its position (i.e. mode 1), the envelope will never reach position 601*c* or beyond. The foregoing description of a preferred embodiment of the invention is not intended to be exhaustive or to limit the invention to the precise form disclosed, and obviously many modifications and variations are possible in light of the above teaching. It is intended that the scope of the instant invention be defined by the claims appended hereto.

What is claimed is:

1. Apparatus for turning flat articles, comprising:

means for receiving a serial stream of said articles traveling along a first linear path, said means including a nonrotating surface;

means for rotating each of said articles through a preselected angle and for steering each of said articles in a preselected angle and for steering each of said articles in a preselected direction of travel wherein said rotating and steering means includes a roller operative over said non-rotating surface, and wherein said receiving means includes a structural support having a substantially flat surface for serially receiving said articles, said flat surface and said roller defining a nip, and wherein said substantially flat surface includes a knurled recess over which said roller tracks a 90° arc whenever said roller pivots with an article in said nip;

means for guiding each of said received articles to said rotating and steering means;

means for conveying each of said rotated articles along a path parallel to said pre-selected direction of travel;

means for adjusting the height of said roller to accommodate rotating articles of differing thickness;

drive means for enabling said roller to pivot whenever said apparatus is being operated in a first mode associated with preselecting 180° as the desired amount of rotation for said articles; and means for fixing the position of said roller to thereby inhibit its pivoting ability whenever said apparatus is being operated in a first mode associated with preselecting 90° as the desired amount of rotating for said articles.

2. Apparatus as set forth in claim 1 wherein said guiding means includes a fixed position fence for guiding each of said articles to said nip.

3. Apparatus as set forth in claim 2 wherein said fence includes a pivot point, in line with the center line of said roller, about which said articles are rotated.

4. Apparatus as set forth in claim 3 further comprising means for biasing received articles whereby said receiving articles are biased toward said nip.

5. Apparatus as set forth in claim 3 wherein said biasing means causes said received articles to be caught by said nip.

6. Apparatus as set forth in claim 1 wherein said drive means causes said roller assembly to pivot over said track only when an article is caught in the nip of said roller.

7. Apparatus as set forth in claim 1 wherein said drive means comprises a spring bias.

8. Apparatus as set forth in claim 1 wherein said roller traverses said knurled recess track and drives itself back to its initial position whenever an article, rotated 180° by said roller, leaves the nip of said roller.

9. Apparatus as set forth in claim 1 wherein said means for rotating and steering further comprises means for urging said articles to continue along said first linear path whenever said apparatus operates in said first mode.

10. Apparatus as set forth in claim 9 wherein said means for urging comprises:

(a) a solenoid; and (b) a pin, dirven by said solenoid, which in said first mode is above said flat surface and in said second mode is below said flat surface.

11. Apparatus as set forth in claim 1 wherein said fixing means comprises:

(a) a solenoid; and (b) at least one pin, driven by said solenoid, for fixing the position of said roller assembly in said first mode.

* * * * *